US006502444B1

(12) United States Patent
Kanemitsu et al.

(10) Patent No.: US 6,502,444 B1
(45) Date of Patent: Jan. 7, 2003

(54) METHOD OF FORMING A CYLINDRICAL PORTION OF A SHEET METAL MEMBER HAVING A CENTER HOLE

(75) Inventors: Toshiaki Kanemitsu, Kobe (JP); Kunihiro Harada, Miki (JP); Naoki Fujii, Kobe (JP)

(73) Assignee: Kabushiki Kaisha Kanemitsu, Hyogo (JP)

( * ) Notice: Subject to any disclaimer, the term of this patent is extended or adjusted under 35 U.S.C. 154(b) by 485 days.

(21) Appl. No.: 09/029,265

(22) PCT Filed: Aug. 5, 1996

(86) PCT No.: PCT/JP96/02213

§ 371 (c)(1),
(2), (4) Date: Mar. 10, 1998

(87) PCT Pub. No.: WO98/05446

PCT Pub. Date: Feb. 12, 1998

(51) Int. Cl.[7] ..... B21D 22/14
(52) U.S. Cl. ..... 72/110
(58) Field of Search ..... 72/68, 110; 29/892, 29/892.3

(56) References Cited

U.S. PATENT DOCUMENTS 4,621,514 A * 11/1986 Dohmann et al. ..... 72/355.4
5,195,241 A * 3/1993 Bradfield ..... 72/356

FOREIGN PATENT DOCUMENTS

JP 59-47034 3/1984
JP 61-162234 7/1986
JP 63-140732 6/1988
JP 6-182476 * 7/1994 ..... 72/68

* cited by examiner

*Primary Examiner*—Lowell A. Larson
(74) *Attorney, Agent, or Firm*—Jones, Tullar & Cooper, P.C.

(57) ABSTRACT

A method of forming a cylindrical portion of a sheet metal member having a center hole, according to the present invention, comprises the steps of holding a sheet metal material having a boss portion between rotating dies, rotating the sheet metal material with the rotating dies, and pressing a cylindrical portion formed at an outer periphery of the base plate of the sheet metal material by means of a forming roller, thereby forming the cylindrical portion. In the method of forming a cylindrical portion according to the present invention, a force for pressing the cylindrical portion of the sheet metal material by the forming roller, is supported by engagements of the rotating dies engaged with engaged portions disposed on the base plate, thereby never causing a state wherein, against a rod portion of the rotating die, a boss portion of the sheet metal material fitted by the rod portion are strongly pressed, and making it possible to maintain accurately the shape and measurements of the center hole prior to forming the cylindrical portion, even after forming the cylindrical portion.

3 Claims, 7 Drawing Sheets

20
A
2
6
95a(9a)
96a
3
4
94a
97a
95a(9a)
96a
4
3
2
5
92a
93a
5
20a
h
g
93
91a(9a)
7
92
91a(9a)

METHOD OF FORMING A CYLINDRICAL PORTION OF A SHEET METAL MEMBER HAVING A CENTER HOLE

TECHNICAL FIELD

The present invention relates to a method of forming a cylindrical portion of a sheet metal member, the cylindrical portion to being a pulley having a belt winding-hanging portion for rollingly hanging a flat belt, a V-shaped belt, a poly-V-belt or the like, and having a gear provided with teeth on an inner surface or an outer surface of the cylindrical portion. Specifically, the present invention relates to a method of pressing the cylindrical portion of the sheet metal member having a center hole or a boss portion, which requires to be a high degree of accuracy as to its shape, or its measurements, disposed on a center of a circular base plate, in a radial direction of the base plate by means of a forming roller, thus shaping it into a predetermined shape or length.

BACKGROUND OF THE INVENTION

When forming a cylindrical portion of a sheet metal member having a center hole, wherein a cylindrical boss portion protrudes from a center of a circular base plate whose outer periphery is connectedly provided with a cylindrical portion, and the sheet metal material having the center hole is formed by the boss portion it is known to hold the sheet metal material is between rotating dies. A rod portion arranged at the rotating die is fitted into the center hole, so as to align a rotating axis center of the rotating die with the center of the base plate, thereby rotating the sheet metal material with the rotating dies, while pressing the cylindrical portion in a radial direction of the base plate by means of a forming roller leading to forming the cylindrical portion. The influence of pressure by means of the forming roller shifts the base plate slightly radially, a circumferential part of the boss portion is pressed strongly against the rod portion, whereby high accuracy as to shape and measurements of the sheet metal member as a final product obtained by forming the cylindrical portion cannot be achieved owing to distorted transformation of the center hole formed by the boss portion. Accordingly, conventionally, after forming the cylindrical portion, the center hole has been cut again to maintain the high accuracy thereof. Similarly, when forming a cylindrical portion by use of the sheet metal material wherein the center hole is formed by a circular opening disposed on the center of the base plate, the same state is possibly caused.

SUMMARY OF THE INVENTION

It is an object of the present invention to provide a method of forming a cylindrical portion of a sheet metal member having a center hole, wherein, in the case of forming a cylindrical portion according to the above mentioned method, there is no fear of deteriorating the accuracy of the center hole arranged on the center of the base plate owing to the influence of the pressure of the forming roller.

In order to achieve the above noted object, a method of forming a cylindrical portion of a sheet metal member having a center hole, according to the present invention, comprises the steps of:

holding a circular base plate of a sheet metal material having a center hole disposed on the base plate, in an interposed state, between rotating dies, fitting a rod portion concentrically with each rotating axis center, disposed on the rotating dies, into the center hole of the sheet metal material, making the sheet metal material rotate with the rotating dies, and pressing a cylindrical portion connectedly disposed on an outer periphery of the base plate in a radially inward direction of the base plate by means of a forming roller, so as to form the cylindrical portion, wherein each engagement disposed on portions where the rotating dies are overlapped with the base plate, is engaged with each engaged portion disposed on the base plate, so as to prevent the base plate from moving radially.

The center hole includes a hole formed by a circular opening disposed on the center of the base plate and a hole formed by a cylindrical boss portion, connecting to the center of the base plate.

According to the above method of forming the cylindrical portion, a force presses the cylindrical portion of the sheet metal material in a radial direction thereof by means of the forming roller, and the cylindrical portion is supported by the engagement of the rotating die engaged with the engaged portion via the engaged portion of the base plate, thereby preventing the base plate from moving slightly. Consequently, during forming, an influence of pressure by the forming roller prevents a state wherein a hole circumference of the center hole of the sheet metal material fitted by the rod portion on the side of the rotating die, is strongly pressed against the rod portion to transform it distortedly, so that accuracy in the shape and measurements of the center hole prior to forming the cylindrical portion is maintained even after it is formed.

Preferably, according to the present invention, as the rotating dies, a first rotating die and a second rotating die for holding the base plate are employed, and the engagements disposed on both the first and second rotating dies, are respectively engaged with the engaged portions respectively disposed on a front surface and a back surface of the base plate, so as to prevent the base plate from radially moving.

Thus, the force in pressing the cylindrical portion of the sheet metal material in a radial direction by means of the forming roller is supported by each engagement of the first rotating die and the second rotating die engaged with each engaged portion via each engaged portion disposed on the front and back surfaces of the base plate. Accordingly, this ensures an effect wherein the accuracy in the shape and measurements of the center hole of the cylindrical portion prior to forming the cylindrical portion mentioned above, is maintained even after forming the cylindrical portion.

In the present invention, preferably, the engagements and the engaged portions are circularly annular with the result that the forming roller presses the cylindrical portion of the sheet metal material rotating with the rotating dies in a radial direction, thereby always exhibiting an effect of supporting the force by the cooperation of the engaged surfaces of the engaged portions.

DETAILED DESCRIPTION OF THE PREFERRED EMBODIMENTS

Figure 2:
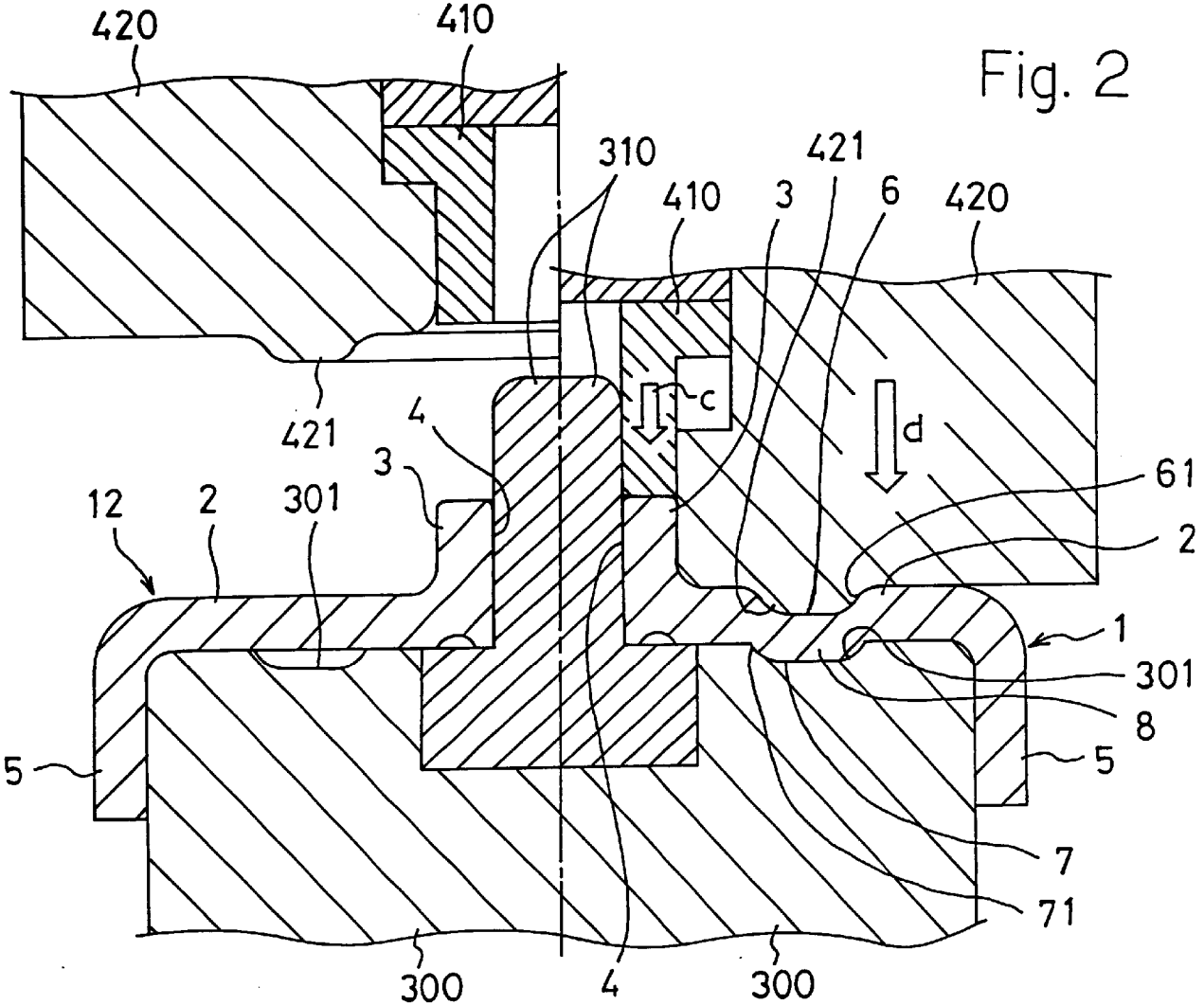
In FIG. 2, the left half thereof is a sectional view illustrating a pre-step prior to a step of forming an engaged portion at a base plate of the sheet metal material, and the right half thereof is a sectional view illustrating the step of forming the engaged portion at the base plate of the sheet metal material.

As shown in a right half in FIG. 2, a sheet metal material 1 as a mother material employed for a method of forming a cylindrical portion according to the present invention, has a hole center 4 disposed on a circular base plate 2, and a cylindrical portion 5 extending from either side of the base plate 2, as to be integrated with an outer periphery of the base plate 2. Moreover, a front surface of the base plate 2 is provided with a circularly annular concave surface 6 concentric with the center hole 4, and a back surface thereof is provided with a circularly annular convex surface 7 concentric with the center hole 4. The concave surface 6 and the convex surface 7 make a circularly annular extrusion 8 formed on the base plate 2, so as to extruded to the back surface, thereby including by the base plate 2. Stepped areas positioned at the outer periphery of the convex surface 6 and stepped areas positioned at the inner periphery of the concave surface 7 are respectively designated as engaged portions 61 and 71. In the sheet metal material 1, the center hole 4 corresponds to a hole formed by a cylindrical boss portion 3 connectedly integrated with the base plate 2 at the center thereof. The boss portion 3 is formed connectedly so as to be integrated with the base plate 2 by means of a burring process or the like.

Figure 1:
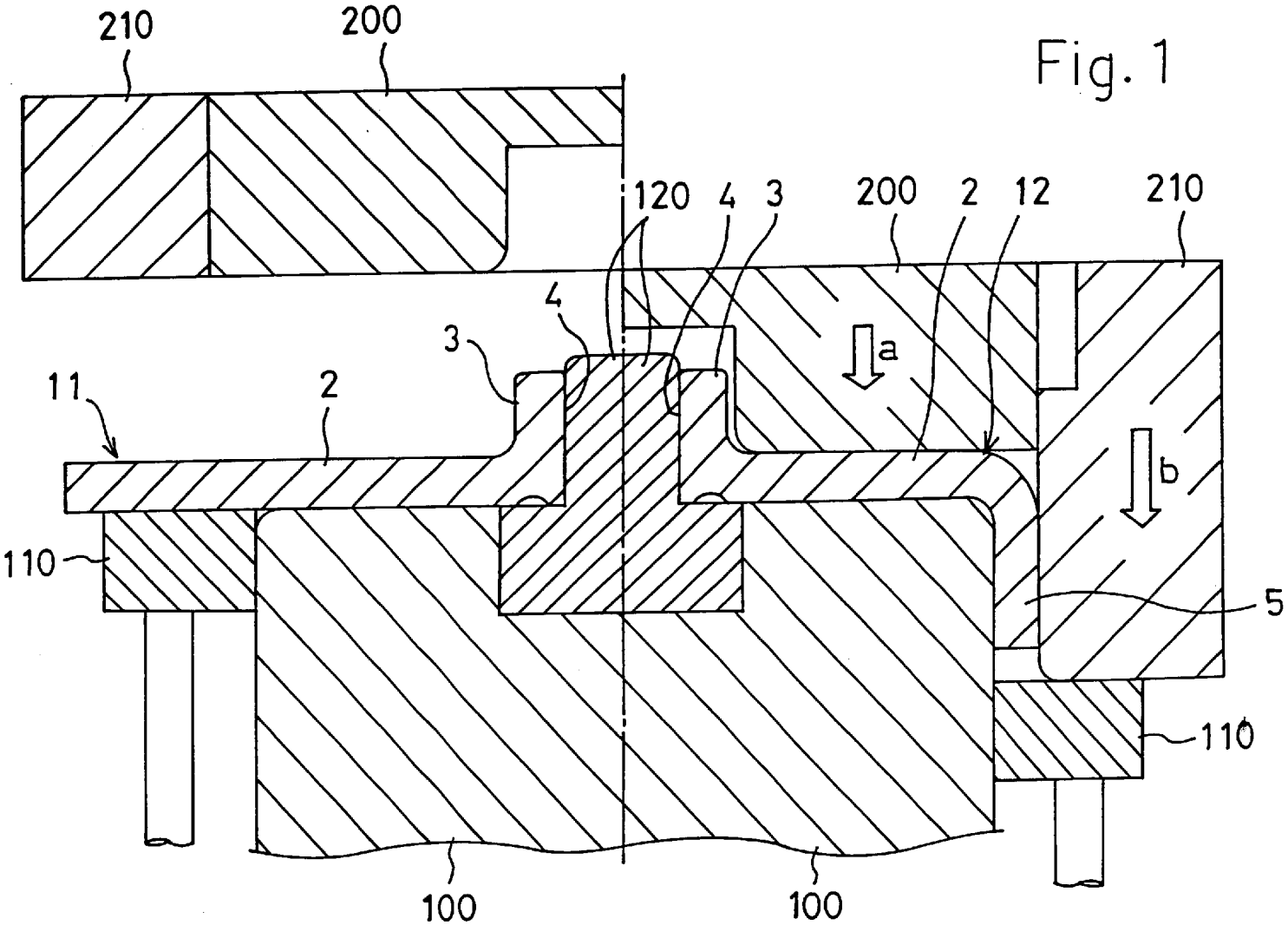
In FIG. 1, the left half thereof is a sectional view illustrating a pre-step prior to a step of forming a cylindrical portion at a sheet metal material integrated with a boss portion according to the present invention, and the right half thereof is a sectional view illustrating the step of forming the cylindrical portion at the sheet metal material integrated with the boss portion according to the present invention.

The cylindrical portion 5 is formed by a pre-step prior to a step of forming a cylindrical portion and the step of forming the cylindrical portion, concretely shown in FIG. 1. In other words, as shown in a left part in FIG. 1, a sheet metal material 11 having integrally the boss portion 3, is mounted on a lower die 100 and a movable lower die 110 arranged at a circumference thereof, and the boss portion 3 is fitted by a rod portion 120 arranged at the lower die 100, thereby deciding a position of the sheet metal material 11 by the rod portion 120. As shown in the right half in FIG. 1, a holding upper die 200 and a pressing upper die 210 arranged at a circumference thereof are lowered in the direction of arrows a and b, and the base plate 2 is pressed against the lower die 100 by the holding upper die 200, thereby holding the base plate 2 between the holding upper die 200 and the lower die 100, and bending the base plate 2 by the pressing upper die 210 for forming the cylindrical portion 5.

The engaged portions 61 and 71 are formed by a pre-step prior to a step of forming an engaged portion and the step of forming the engaged portion, shown in FIG. 2. In other words, as shown in the left part in FIG. 2, a sheet metal material 12 having integrally the boss portion 3, is mounted on a lower die 300 and a rod portion 310 arranged at the lower die 300 is fitted into the boss portion 3, thereby deciding a position of the sheet metal material 12 by use of the rod portion 310. As shown in the right half in FIG. 2, a holding upper die 410 and a pressing upper die 420 arranged at a circumference thereof are lowered in the direction of arrows c and d, and the boss portion 3 are pressed by the holding upper die 410, thereby holding the boss portion 3 between the holding upper die 410 and the lower die 300, and pressing a radially middle portion of the base plate 2 downwardly by a circularly annular extrusion 421 arranged on the pressing upper die 420, so as to extrude the pressed portion in a circularly annular concave area 301.

The step of forming the cylindrical portion is applied to the cylindrical portion 5 of the sheet metal material 1 formed by the steps shown in FIGS. 1 and 2. In this embodiment, the step of forming the cylindrical portion is divided into a first step shown in FIG. 3 and a second step shown in FIG. 4 following the first step.

Figure 3:
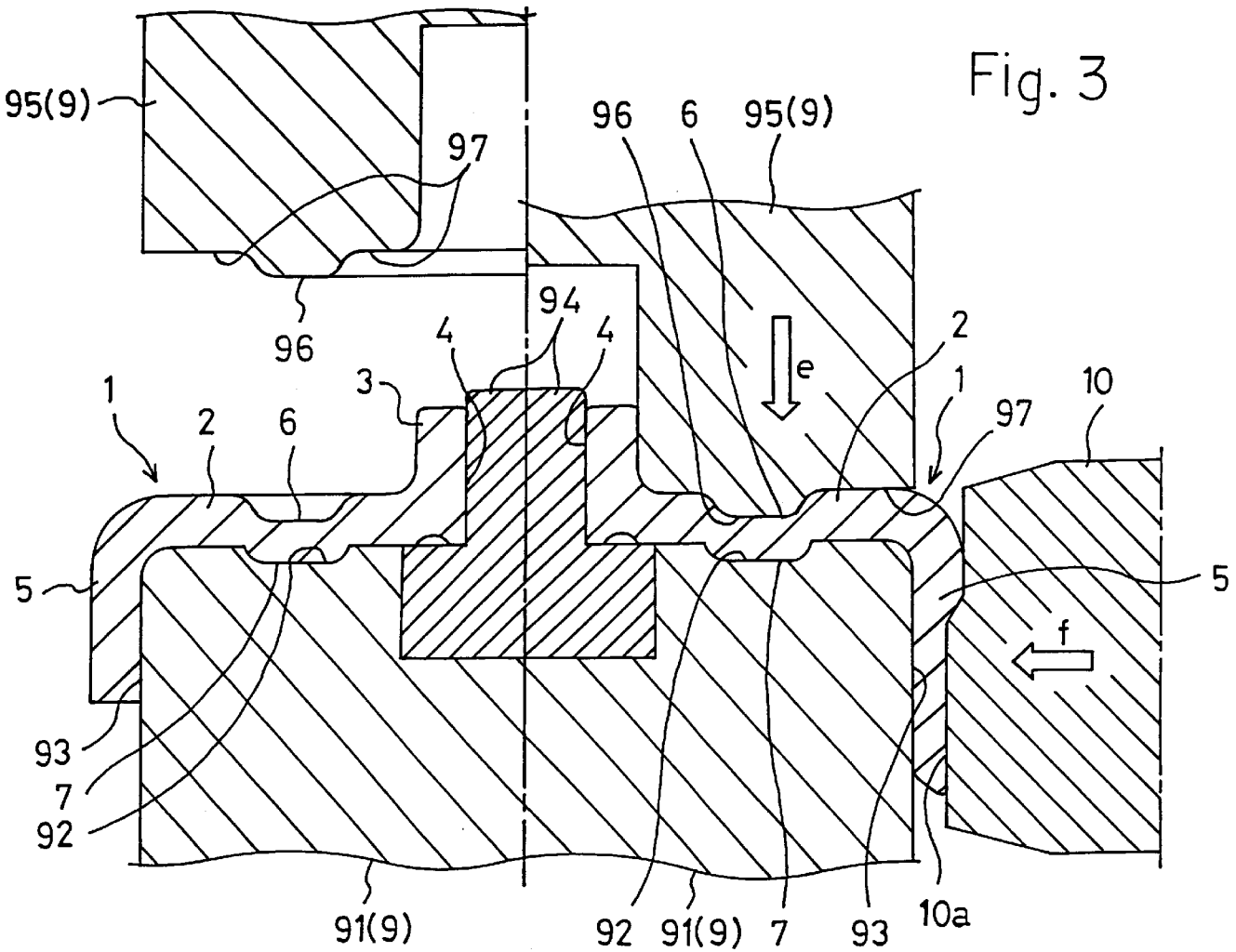
In FIG. 3, the left half is a sectional view illustrating a pre-step prior to a first step included by the step of forming the cylindrical portion of the sheet metal material, and the right half thereof is a sectional view of the first step included by the step of forming the cylindrical portion of the sheet metal material.

In the first step shown in FIG. 3, rotating dies 9 having the function of holding the base plate 2 of the sheet metal material 1, and a forming roller 10 for pressing the cylindrical portion 5 in a radially inward direction of the base plate 2 are employed. As shown in FIG. 3, the rotating dies 9 comprise a first rotating die 91 and a second rotating die 95. The first rotating die 91 includes an annular concave recess surface 92 overlapped with the convex surface 7 of the extrusion 8 and a cylindrical supporting face 93 to which the cylindrical portion 5 is fitted, and a rod portion 94 concentrically disposed with the rotating axis center. On the other hand, the second rotating die 95 includes an annular convex surface 96 overlapped with the concave surface 6 of the extrusion 8, and a holding surface 97 positioned on either side of the convex surface 96. Moreover, the forming roller 10 has a cylindrical shaping surface 10*a*.

Figure 4:
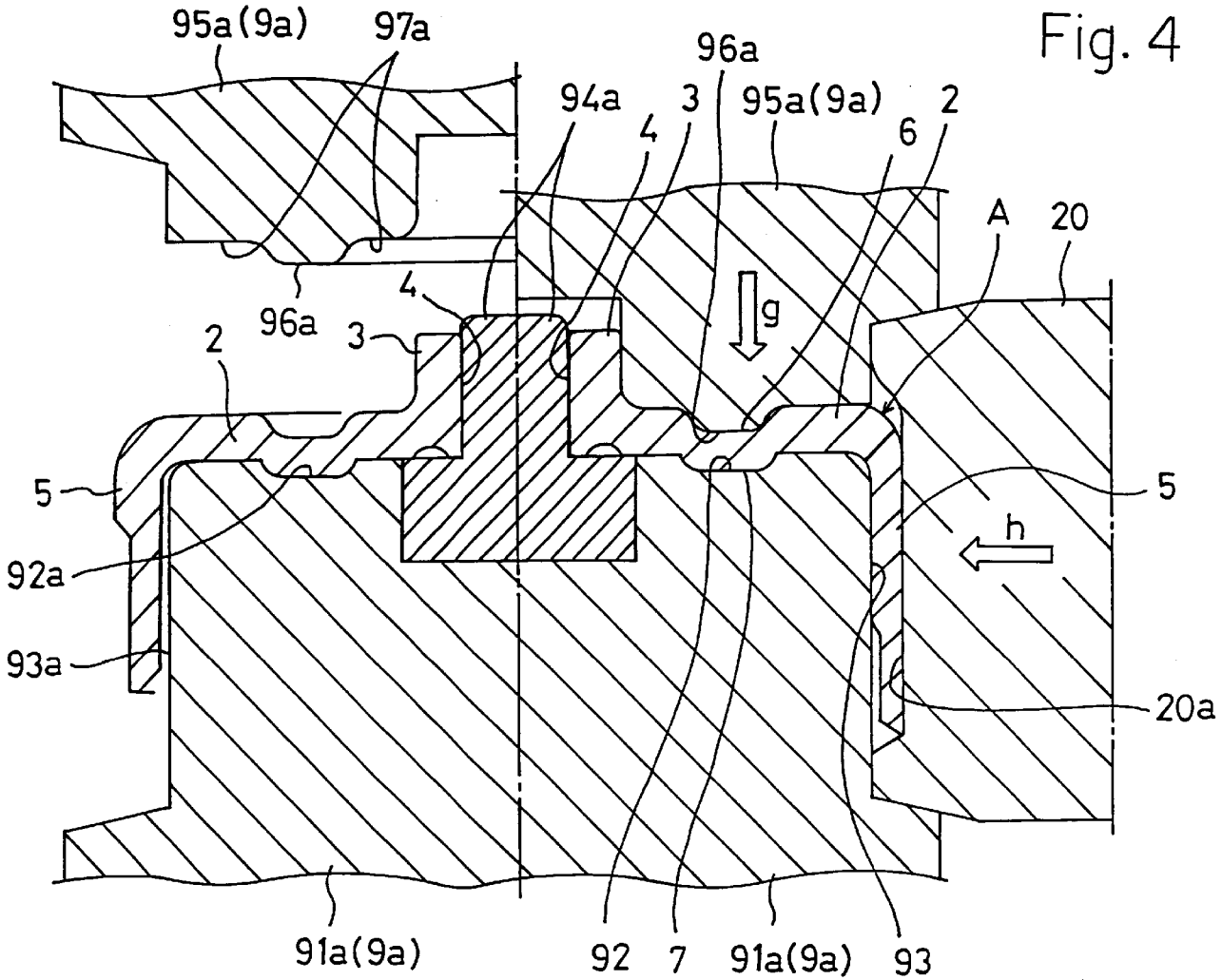
In FIG. 4, the left half is a sectional view illustrating a pre-step prior to a second step included by the step of forming the cylindrical portion of the sheet metal material, and the right half thereof is a sectional view of the second step included by the step of forming the cylindrical portion of the sheet metal material.

Also, in the second step shown in FIG. 4, a rotating die 9*a* functioning to hold the base plate 2 of the sheet metal material 1, and a forming roller 20 for pressing the cylindrical portion 5 in the radially inward direction of the base plate 2 are employed. As shown in FIG. 4, the rotating die 9*a* comprises a first rotating die 91*a* and a second rotating die 95*a*. There is a difference between the first rotating die 91*a* and the first rotating die 91 shown in FIG. 3 which resides in the fact that the first rotating die 91*a* is radially smaller than the first rotating die 91. Consequently, the first rotating die 91*a* includes an annular concave recess surface 92*a*, a cylindrical supporting face 93*a*, and a rod portion 94*a*. On the other hand, the second rotating die 95*a*, in the same way as the second rotating die 95 shown in FIG. 3, includes an annular convex surface 96*a* and a holding surface 97*a*. Moreover, the forming roller 20 has a cylindrical shaping surface 20*a* which extend in the axial direction.

In the first step, as shown in the left half in FIG. 3, the sheet metal material 1 integrally having the boss portion 3 is mounted on the first rotating die 91, the convex surface 7 of the base plate 2 is fittedly overlapped with the concave recess surface 92 of the first rotating die 91, and the rod portion 94 of the first rotating die 91 is fitted into the boss portion 3, thereby positioning the sheet metal material 11 by the rod portion 120. Then, as shown in the right half in FIG. 3, the second rotating die 95 is lowered in the direction of an arrow e, and the convex surface 96 is fittedly overlapped with the concave surface 6 of the base plate 2. Thus, the base plate 2 of the sheet metal material 1 is held between the first rotating die 91 and the second rotating die 95 by means of a great force, before transmitting rotation to either the first rotating die 91 or the second rotating die 95, thereby making the sheet metal material 1 is rotated with either the first rotating die 91 or the second rotating die 95.

While rotating the first sheet metal material 1 in this way, the forming roller 10 is moved in a direction of the arrow f, to press the cylindrical portion 5 in the radial direction of the base plate 2. Thus, the forming roller 10 rotatably follows the sheet metal material 1, thereby gradually extending the cylindrical portion 5 in the axial direction thereof. In the first step, approximately only the lower half of the cylindrical portion 5 is previously extended.

In the second step, as shown in the left half in FIG. 4, the second rotating die 95*a* is opposed to the sheet metal material 1 obtained by the first step. Thereafter, as shown in the right half in FIG. 4, the second rotating die 95*a* is lowered in an arrow g, so that the convex surface 96*a* is fittedly overlapped with the concave surface 6 of the base plate 2. Thus, the base plate 2 of the sheet metal material 1 is held between the first rotating die 91*a* and the second rotating die 95*a* by a great force before transmitting rotation to either the first rotating die 91*a* or the second rotating die 95*a*, thereby the sheet metal material 1 is rotated with either the first rotating die 91*a* or the second rotating die 95*a*.

While rotating the sheet metal material 1 in this way, the forming roller 20 is moved in the direction of the arrow h, thus pressing a not-yet-extended portion of an appropriately upper half of the cylindrical portion 5 in a radially inward direction of the base plate 2. As a result, the forming roller 20 rotatably follows the sheet metal material 1 so that the cylindrical portion 5 is axially extended to have a predetermined length.

Figure 7:
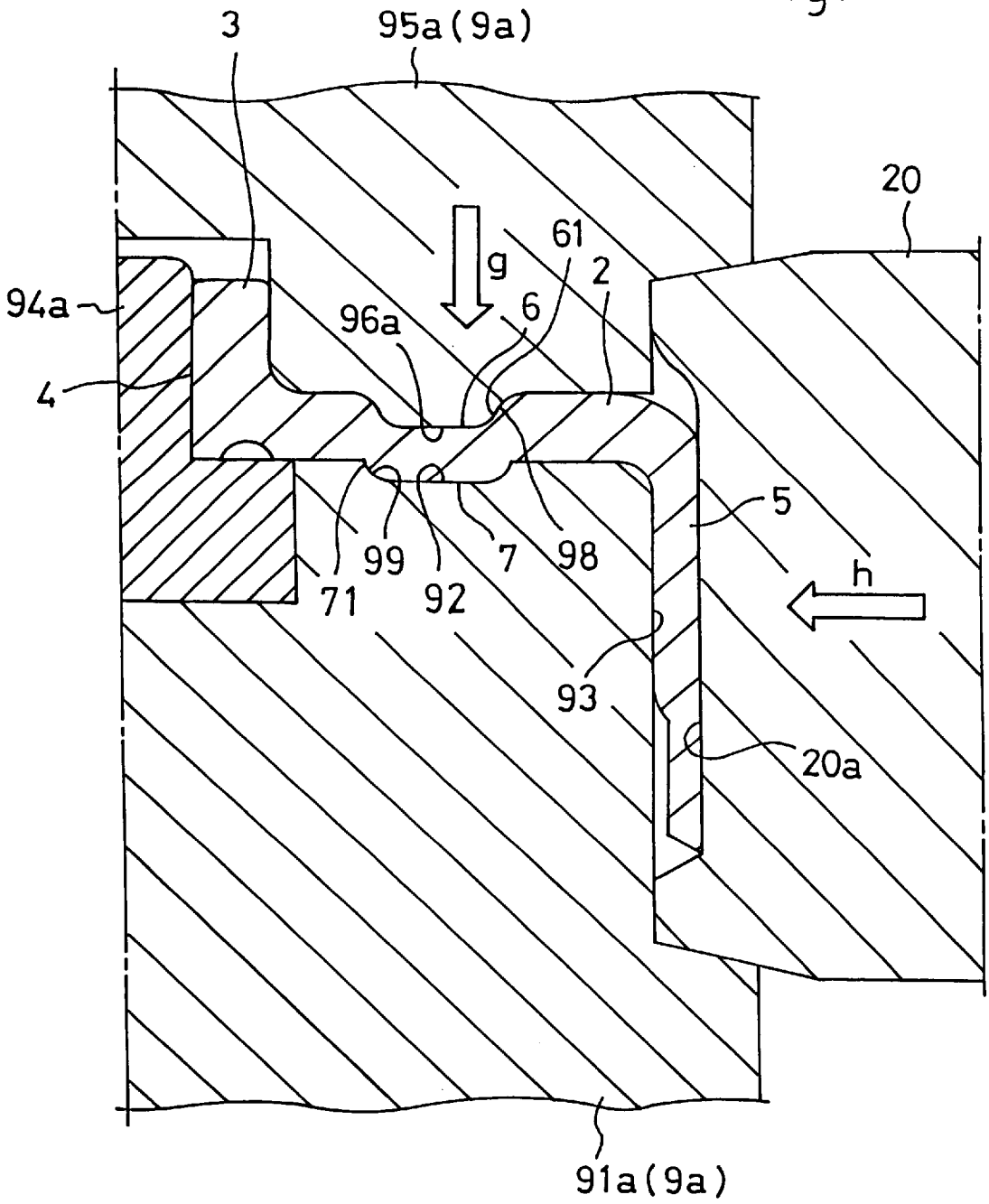
FIG. 7 is an enlarged view of the right half of FIG. 4.

As illustrated in FIG. 7 which is an enlarged view of the right half in FIG. 4, in the second step included by the step of forming the cylindrical portion, when the cylindrical portion 5 is pressed by the forming roller 20 in the radial direction of the base plate 2, the stepped engaged portion 61 arranged on the concave surface 6 of the base plate 2 is engaged with an engagement 98 formed by the stepped area of the outer periphery of the convex surface 96*a* of the second rotating die 95*a*, and the stepped engaged portion 71 arranged on the convex surface 7 of the base plate 2 is engaged with an engagement 99 formed by the stepped area of the inner periphery of the concave recess surface 92*a* of the first rotating die 91*a*. Consequently, a force or a load in pressing the cylindrical portion 5 (cf. FIG. 4) in a radial direction of the base plate 2 by the forming roller 20 is supported by the respective engagements 98 and 99 of the first and second rotating dies 91*a* and 95*a* through the engaged portions 61 and 71 of both of the front and back surfaces of the base plate 2, thereby preventing the base plate 2 from moving slightly. Therefore, an influence of pressure by the forming roller 20 prevents a state wherein a hole circumference of the center hole 4 of the boss portion 3 fitted by the rod portion 94*a* of the first rotating die 91*a* is intensively pressed against the rod portion 94*a*, leading to deformation. Then, was accuracy of the shape and measurements of the center hole 4 prior to the second step is maintained in that of the center hole 4 subjected to the second step. The same effect as this is reached in the second step included by the step of forming the cylindrical portion in FIG. 3. Therefore, the accuracy of the shape and measurements of the center hole 4 under a condition wherein the step of forming the cylindrical portion is not yet applied to the center hole 4 is still maintained even after it is applied to the center hole 4.

The cylindrical portion 5 of a sheet metal material A (i.e., the right half in FIG. 4) obtained by the step of forming the cylindrical portion may be provided with a belt winding-hanging portion for rollingly hanging a belt such as a flat belt, a V-shaped belt and a poly-V-belt, and teeth at an inner surface or an outer surface thereof.

Figure 5:
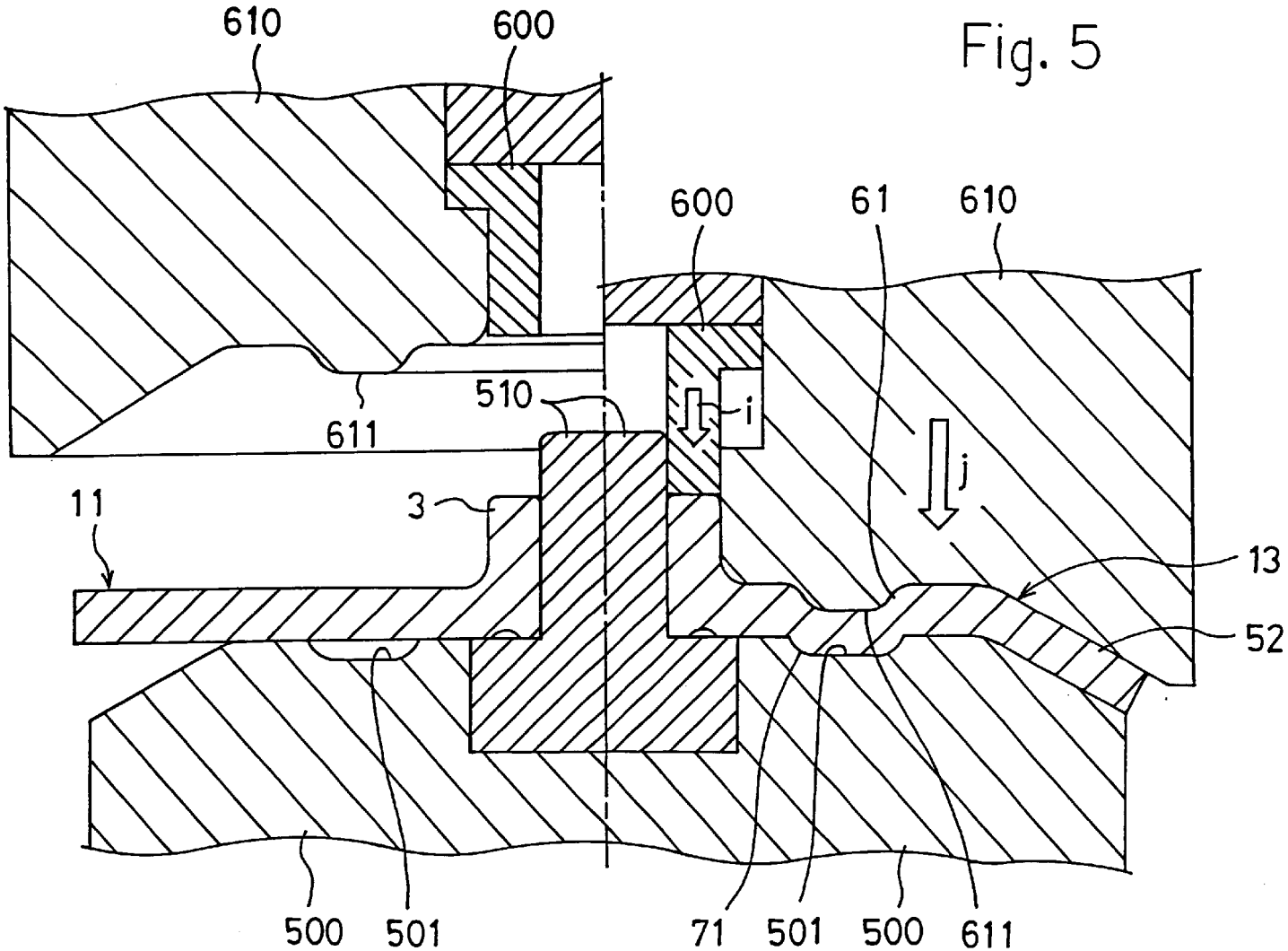
In FIG. 5, the left half is a sectional view illustrating a pre-step prior to a step of forming an inclining wall at the sheet metal material integrated with the boss portion, and the right half thereof is a sectional view of the step of forming the inclining wall at the sheet metal material integrated with the boss portion.
Figure 6:
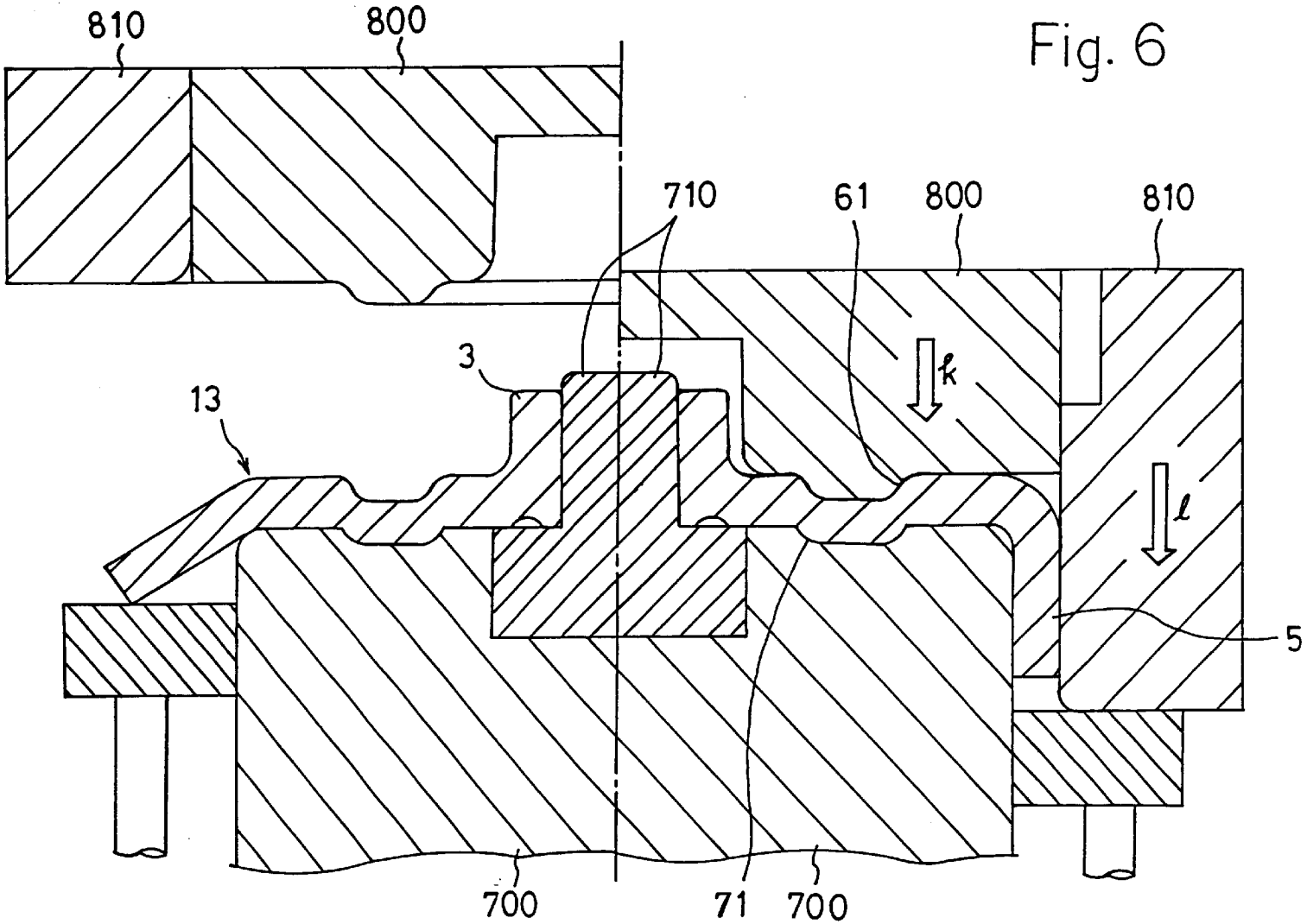
In FIG. 6, the left half is a sectional view illustrating a pre-step prior to a step of forming the inclining wall of the sheet metal material at the cylindrical portion, and a right half thereof is a sectional view of the step of forming the inclining wall of the sheet metal material at the cylindrical portion.

FIGS. 5 and 6 illustrate another embodiment of the step for forming the cylindrical portion 5 and the engaged portions 61 and 71.

In the step in FIG. 5, as illustrated in the left half thereof, the sheet metal material 11 integrally having the boss portion 3 is mounted on a lower die 500, and the boss portion 3 is fitted by a rod portion 510 arranged at the lower die 500, thereby positioning the sheet metal material 11 by the rod portion 510. Then, as illustrated in the right half thereof, a holding upper die 600 and a pressing upper die 610 arranged at a circumference thereof are lowered in the direction of the arrows i and j, the holding upper die 610 pushingly holds the boss portion 3, thereby holding the boss portion 3 between the holding upper die 600 and the lower die 500, and a circularly annular projection 611 arranged at the pressing upper die 610 presses a radially middle portion of the base plate 2 downwardly, thus extruding the pressed portion into a circularly annular concave portion 501 arranged at the lower die 500. Moreover, a predetermined area of the outer periphery of the sheet metal material 11 is held between the lower die 500 and the pressing upper die 610, so as to be inclined in a state of widening as it approaches an end thereof, thereby forming an inclining wall 52. As the result of conducting this step, both of the front and back sides of the base plate 2 are provided with the engaged portions 61 and 71.

In the step in FIG. 6, a sheet metal material 13 having the engaged portions 61 and 71 and the inclining wall 52 is mounted on a lower die 700, and a rod portion 710 arranged at the lower die 700 is fitted into the boss portion 3, thereby positioning the sheet metal material 13 by use of the rod portion 710. As illustrated in the right half of FIG. 6, a holding upper die 800 and a pressing upper die 810 arranged at a circumference thereof are lowered in the direction of arrows k and l, and the holding upper die 800 pushingly holds the base plate 2, thereby holding the base plate 2 between the holding upper die 800 and the lower die 700, and bending the base plate 2 by means of the pressing upper die 810, leading to forming the cylindrical portion 5.

Thus, each step of forming the cylindrical portion described in FIGS. 3 and 4 is applied to the sheet metal material 1 having the engaged portions 61 and 71 and the cylindrical portion 5.

According to this embodiment, the step of forming the cylindrical portion is conducted in a state wherein both the front surface and the back surface of the base plate 2 are respectively provided with the engaged portions 61 and 71, and the engaged portions are engaged with the engagements 98 and 99 respectively arranged at the rotating dies 9 and 9*a*, in a radial direction of the base plate 2, thus preventing the base plate 2 from moving so that the step of forming the cylindrical portion is performed. However, it may be performed in a state wherein either the front surface only or the back surface thereof is provided with the engaged portion, the engaged portion being engaged with the engagement arranged on the side of the rotating die, in a radial direction of the base plate 2, so as to prevent the base plate 2 from moving. Furthermore, the extrusion 8 may be extruded to the front surface of the base plate 2, thus forming the engaged portions 61 and 71.

In addition, the center hole 4 of the base plate 2 may be simply a circular hole disposed on the center of the base plate 2.

In a method of forming a cylindrical portion of a sheet metal member having a center hole according to the present invention, a force to press the cylindrical portion of the sheet metal material in a radially inward direction of the base plate by means of a forming roller, is supported by engagements of rotating dies engaged with the engaged portions via the engaged portions of the base plate. Consequently, a pressure influence by the forming roller prevents a state wherein a hole circumference of the center hole of the sheet metal material fitted by a rod portion of the rotating die is strongly pressed against the rod portion, thereby bringing an effect wherein accuracy of the shape and measurements of the center hole prior to forming the cylindrical portion is maintained even after forming it.

What is claimed is:

1. A method of forming a cylindrical portion of a sheet metal member having a circular base plate with a cylindrical boss portion at the center of the base plate, and a cylindrical portion connected to an outer periphery of the base plate, the method comprising the steps of:

forming a center hole in the cylindrical boss portion;

holding the circular base plate of the sheet metal material between rotating dies, each die defining a center axis;

fitting a rod portion to be concentric with the center axis of each rotating die, into the center hole of the sheet metal material;

rotating the sheet metal material with each rotating die while pressing the circular base plate with each rotating die;

pressing the cylindrical portion in a radially inward direction of the base plate by means of a forming roller, so as to form the cylindrical portion; and engaging the cylindrical boss portion while pressing the circular base plate to form the engagement portions of the base plate, wherein the rotating dies and the base plate define engagements portions, and wherein the rotating dies overlap with the base plate and form engagements of the engagement portions, with each engagement portion disposed on the base plate, and the rotating die opposed to a tip of the cylindrical boss portion does not come in contact with the tip of the cylindrical boss portion, thereby preventing the base plate from moving radially when pressing the cylindrical portion in the radially inward direction.

2. A method of forming a cylindrical portion of a sheet metal member according to claim 1, wherein a first rotating die and a second rotating die for holding the base plate serve as the rotating dies, and the engagement portions disposed on both of the first and second rotating dies, are respectfully engaged with the engagement portions disposed on a front surface and a back surface of the base plate, so as to prevent the base plate from radially moving when pressing the cylindrical portion in the radially inward direction.

3. A method of forming a cylindrical portion of a sheet metal member having a center hole according to claim 1, wherein the engagement portions are circularly annular.

* * * * *